US006135090A

United States Patent [19]

Kawachi et al.

[11] Patent Number: 6,135,090

[45] Date of Patent: Oct. 24, 2000

[54] FUEL INJECTION CONTROL SYSTEM

[75] Inventors: Katsuyoshi Kawachi, Tochigi; Yukio Matsumoto; Kazumitsu Kobayashi, both of Gunma, all of Japan

[73] Assignee: Unisia Jecs Corporation, Atsugi, Japan

[21] Appl. No.: 09/213,754

[22] Filed: Dec. 17, 1998

[30] Foreign Application Priority Data

Jan. 7, 1998 [JP] Japan ..... 10-013470

[51] Int. Cl.[7] ..... F02M 37/04

[52] U.S. Cl. ..... 123/446; 123/506

[58] Field of Search ..... 123/506, 446, 123/447, 458, 457

[56] References Cited

U.S. PATENT DOCUMENTS

| | | | |
|---|---|---|---|
| 5,343,845 | 9/1994 | Fehlmann | 123/506 |
| 5,478,213 | 12/1995 | Harris et al. | 123/506 |
| 5,529,042 | 6/1996 | Augustin et al. | 123/509 |
| 5,577,892 | 11/1996 | Schittler et al. | 123/506 |
| 5,911,208 | 6/1999 | Furusawa et al. | 123/506 |

FOREIGN PATENT DOCUMENTS

| | | |
|---|---|---|
| 62-258160 | 11/1987 | Japan . |
| 2-146256 | 6/1990 | Japan . |

*Primary Examiner*—Thomas N. Moulis
*Attorney, Agent, or Firm*—Foley & Lardner

[57] ABSTRACT

A fuel injection control system for an internal combustion engine comprises a plurality of fuel injector valves, a pumping system having a suction valve, a discharge valve, and a high-pressure pump section sucking fuel into a pressurized chamber with the suction valve opened on a suction stroke and for discharging the fuel in the pressurized chamber toward the injector valves with the discharge valve opened on a discharge stroke. A relief passage is connected, at one end, to a lowpressure line upstream of the suction valve. The other end of the relief passage is connected to the pressurized chamber. A fuel-pressure control valve is disposed in the relief passage for regulating a fuel pressure of the fuel injected from each of the fuel injector valves by opening the fuel-pressure control valve only for a specified time duration from a controllable middle stage of the discharge stroke to the end of the discharge stroke.

10 Claims, 8 Drawing Sheets

FUEL INJECTION CONTROL SYSTEM

BACKGROUND OF THE INVENTION

1. Field of the Invention

The present invention relates to a fuel injection control system suitable to inject or spray out fuel, stored in a fuel tank of automotive vehicles such as passenger cars, trucks and the like, through injector valves into each individual engine cylinder, and specifically to a system capable of variably controlling or adjusting a fuel-pressure level of fuel delivered to the injector valves.

2. Description of the Prior Art

Generally, a fuel injection control system for automotive engines is comprised of a common rail equipped with a plurality of injector valves used for fuel delivery to each engine cylinder of an internal combustion engine, a fuel pump connected to the common rail for sucking the fuel into its pressurized chamber on a suction stroke and for discharging the fuel from the pressurized chamber toward the common rail on a discharge stroke, and a fuel-pressure control valve capable of controlling or regulating the fuel pressure in the common rail by relieving the fuel in the pressurized chamber of the fuel pump at a predetermined timing. Such conventional fuel injection systems have been disclosed in Japanese Patent Provisional Publication Nos. 62-258160 and 2-146256. In this type of conventional fuel injection control system, the fuel-pressure control valve is typically constructed by a normally-open type electromagnetically-operated solenoid valve. As is generally known, a fuel-pressure control valve, consisting of a normally-open type, electromagnetic solenoid valve, is shifted to its fully-closed state when energized in response to a command signal from a control unit. On the contrary, when the fuel-pressure control valve is de-energized in response to a command signal (an inoperative signal) from the control unit, the control valve is kept in its inoperative state (or in a full-open state). Usually, the control unit would function to relieve fuel in the pressurized chamber into the fuel tank at the latter-half stage of the discharge stroke, by keeping the fuel-pressure control valve at its closed position for a time duration from the start of the suction stroke to the middle stage of the discharge stroke, and by relieving the fuel in the pressurized chamber of the fuel pump into the fuel tank during the latter-half period of the discharge stroke. The actual discharge stroke of the fuel pump corresponds to a particular time duration from the start of the discharge stroke to a time when the fuel-pressure control valve is shifted to the open position. Actually, the control unit adjusts an amount of fuel discharged from the fuel pump and variably controls the fuel pressure in the common rail depending upon the operating condition of the engine, by stopping energisation of the fuel-pressure control valve and by varying a valve-open timing of the fuel-pressure control valve. In such conventional fuel injection control systems, a fuel-pressure control valve is often constructed by a normally-open type electromagnetic solenoid valve. For example, in case that a signal line provided between the fuel-pressure control valve and the control unit is broken, or when the electromagnetic actuator employed in the fuel-pressure control valve fails, there is a possibility that the fuel-pressure control valve cannot be moved to the closed position. In such cases, that is, owing to the signal-line failure or the fuel-pressure control valve failure, the fuel-pressure control valve remains open. Under this condition, the fuel in the pressurized chamber of the fuel pump would be relieved toward the fuel tank all over the discharge stroke. As set out above, in the conventional fuel injection control systems, when the fuel-pressure control valve cannot be shifted to the closed position owing to troubles such as a signal line failure or a fuel-pressure control valve failure, the fuel cannot be discharged from the fuel pump into the common rail due to fuel relief from the pressurized chamber into the fuel tank with the fuel-pressure control valve unintendedly kept at its full-open position. This results in a drop in fuel pressure of the fuel prevailing in the common rail, and whereby the injection amount of fuel injected from each fuel injector valve tends to become unstable. As previously noted, the conventional fuel injection control system suffers from the drawback that the operating condition of the internal combustion engine deteriorates, when a fuel-pressure control valve, constructed by a normally-open type electromagnetic solenoid valve, cannot be shifted to its closed position due to troubles for example a fuel-pressure control valve failure.

SUMMARY OF THE INVENTION

Accordingly, it is an object of the invention to provide a fuel injection control system which avoids the aforementioned disadvantages of the prior art.

It is another object of the invention to provide a fuel injection system suitable for automotive vehicles, which can ensure fuel supply toward fuel injector valves through a fuel pump, and provide a stable fuel pressure of the injector valve side, and also enhance a reliability of the fuel injection control system.

In order to accomplish the aforementioned and other objects of the present invention, a fuel injection control system for an internal combustion engine, comprises a plurality of fuel injector valves injecting fuel into respective engine cylinders of an internal combustion engine, a pumping system having a suction valve connected between a low-pressure line and a pressurized chamber for permitting fuel flow from the low-pressure line toward the pressurized chamber on a suction stroke, a discharge valve connected between a high-pressure line and the pressurized chamber for permitting fuel flow from the pressurized chamber toward the high-pressure line on a discharge stroke, and a fuel pumping section provided for sucking fuel into the pressurized chamber with the suction valve opened on the suction stroke and for discharging the fuel in the pressurized chamber toward the injector valves with the discharge valve opened on the discharge stroke, a relief passage connected, at one end, to the low-pressure line upstream of the suction valve, and connected, at another end, to the pressurized chamber, and a fuel-pressure control valve disposed in the relief passage for regulating a fuel pressure of the fuel injected from each of the fuel injector valves by opening the fuel-pressure control valve only for a specified time duration from a controllable middle stage of the discharge stroke to an end of the discharge stroke. It is preferable that the fuel-pressure control valve may comprise a normally-closed type relief valve capable of closing during the suction stroke and for a time duration from a start of the discharge stroke to the controllable middle stage of the discharge stroke, and of opening only for the specified time duration from the controllable middle stage of the discharge stroke to the end of the discharge stroke. The fuel injection control system may further comprise a control unit for variably controlling a ratio of a valve-close stroke of the fluid-pressure control valve, defined as a time duration from a start of the suction stroke to the middle stage of the discharge stroke, to a whole stroke corresponding to a time period from the start of the suction stroke to the end of the discharge stroke. The fluid-pressure control valve may comprise a normally-closed type, electromagnetic solenoid valve which comprises a valve casing defining therein a fluid passage, a valve body fluidly disposed in the fluid passage defined in the valve casing, a return spring permanently biasing the valve body in a direction closing the valve body, and an electromagnetic solenoid energized by a command signal generated from the control unit only for the specified time duration from the controllable middle stage of the discharge stroke of the pumping system to the end of the discharge stroke, for maintaining the fuel-pressure control valve at a valve-open state only for the specified time duration. Preferably, the pumping system may comprise a reciprocating fuel pump which comprises at least one cylinder, at least one plunger accommodated in the at least one cylinder so that the at least one plunger is reciprocatable in the at least one cylinder, and cooperating with the at least one cylinder to define the pressurized chamber, and a cam being in cam-connection with an end of the at least one plunger, for converting a rotary motion of the cam into a reciprocating motion of the at least one plunger. The pumping system may comprise a high-pressure pump connected, at a suction side, to a low-pressure pump capable of sucking fuel stored in a fuel tank and discharging the fuel of a low-pressure level, and connected, at a discharge side, to the fuel injector valves. More preferably, the fuel injection control system may further comprise a common rail being formed integral with the fuel injector valves as a gallery type injector valve unit. Furthermore, it is preferable that the control unit outputs a command signal to the fuel-pressure control valve for closing the fuel-pressure control valve during the whole stroke including both the suction stroke and the discharge stroke in presence of a demand for a rapid rise in fuel pressure of the fuel injected from each of the fuel injector valves. Moreover, it is preferable that the control unit outputs a command signal to the fuel-pressure control valve for opening the fuel-pressure control valve during the whole stroke in presence of a demand for a rapid drop in fuel pressure of the fuel injected from each of the fuel injector valves. Preferably, the valve-close stroke may be determined by a target fuel pressure based on an engine speed and an engine load. More preferably, the control unit variably controls a length of the valve-close stroke by varying a timing of opening of the fuel-pressure control valve in the controllable middle stage of the discharge stroke of the pumping system, and also the control unit fixes a timing of closing of the fuel-pressure control valve to the end of the discharge stroke. It is preferable that each of the suction valve and the discharge valve may comprise a one-way check valve.

DESCRIPTION OF THE PREFERRED EMBODIMENTS

Figure 1:
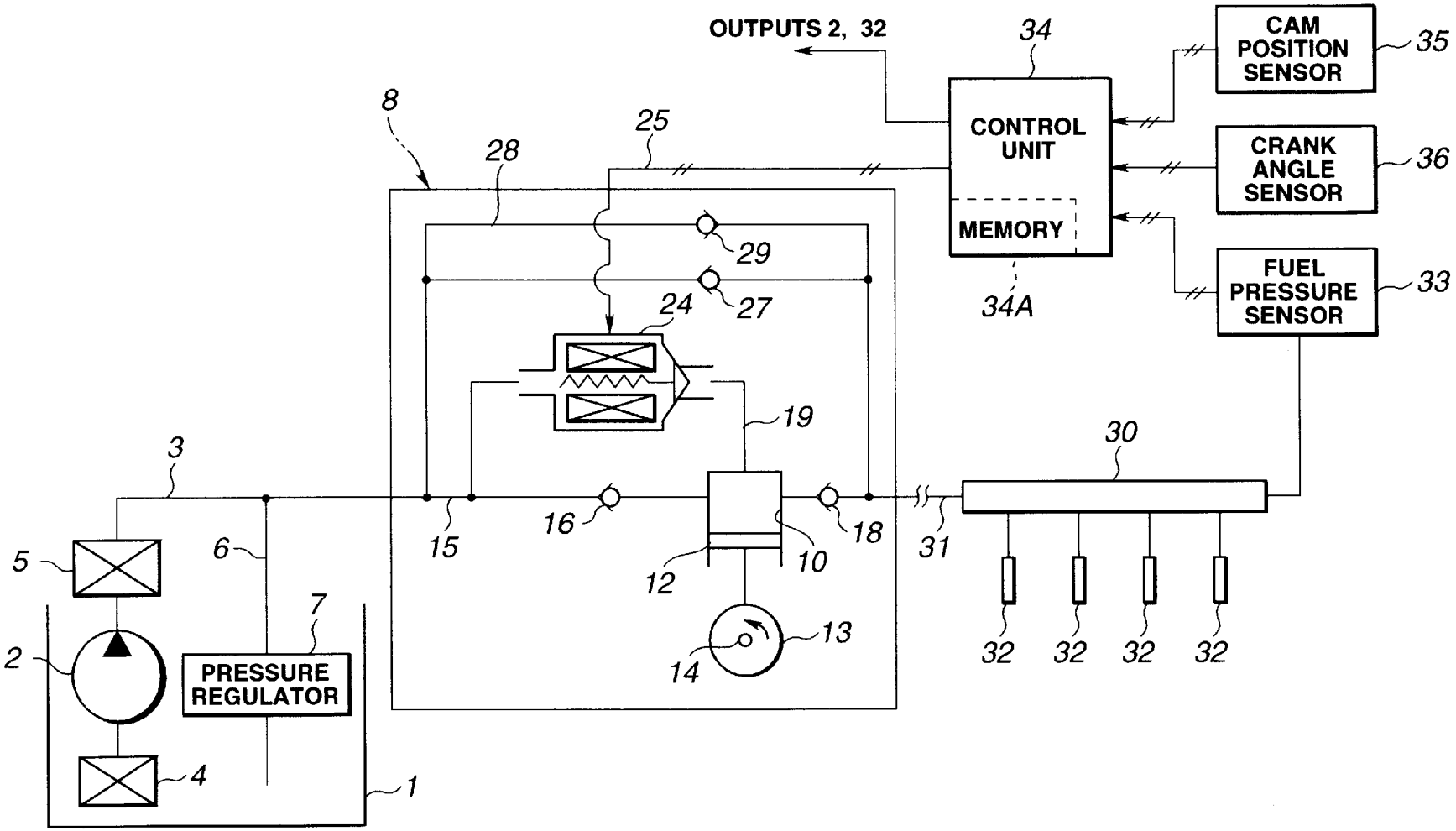
FIG. 1 is a system block diagram illustrating one embodiment of a fuel injection control system of the invention.

Referring now to the drawings, particularly to FIGS. 1 through 8, there is shown a first embodiment of the fuel injection control system of the invention. The fuel injection system of the invention is exemplified in a four-cycle engine of an automotive vehicle. In FIG. 1, reference sign 1 denotes a fuel tank storing fuel injected or sprayed out from fuel injector valves 32 into each individual engine cylinder (not shown). The system of the embodiment shown in FIG. 1 includes a low-pressure pump 2 for feeding or discharging the fuel stored in the fuel tank into a low-pressure line 3 at a low pressure such as 0.3 to 0.5 MPa. As seen in the right-hand side of FIG. 1, a primary filter 4 is fluidly disposed just upstream of the low-pressure pump 2 for purifying the fuel sucked from the fuel tank 1 into the inlet port of the low-pressure pump 2. A secondary filter 5 is fluidly disposed just downstream of the low-pressure pump 2 for purifying the fuel discharged from the low-pressure pump 2 toward the high-pressure pump 8. A return line is also disposed between the low-pressure line 3 and the fuel tank 1. A pressure regulator 7 is provided in the middle of the return line 6. The pressure regulator 7 operates as follows. When the fuel pressure of the fuel flowing through the low-pressure line 3 exceeds a predetermined pressure level, the surplus fuel present in the lowpressure line 3 is returned via the return line 6 into the fuel tank 1 by means of the pressure regulator 7. By virtue of the pressure regulator, the fuel pressure in the low-pressure line 3 can be regulated or maintained at a preset constant low pressure level, for example 0.3 through 0.4 MPa. The outlet side of the low-pressure pump 2 is fluidly connected to the inlet side of the high-pressure pump 8. The high-pressure pump 8 is constructed as a reciprocating fuel pump. As clearly seen in FIGS. 2 and 3, the high-pressure pump 8 comprises a cylinder 10 defined in the pump casing 9, a pump plunger 12 reciprocatingly accommodated in the cylinder 10 and defining a pressurized chamber (or a delivery chamber) 11 in the pump casing by means of the inner wall surface of the cylinder 10 and one end surface of the plunger 12, and a cam 13 being in cam-connection with the other end surface of the plunger 12 for ensuring a reciprocating motion of the plunger 12 within the cylinder 10 during operation of the high-pressure pump 8. The high-pressure pump 8 also comprises a suction fuel passage 15, a suction valve 16, a discharge fuel passage 17, a discharge valve 18, a relief fuel passage 19, and a fuel-pressure control valve 20, which will be fully described later. Each of the suction valve 16 and the discharge check valve 18 is constructed by a one-way check valve.

Figure 2:
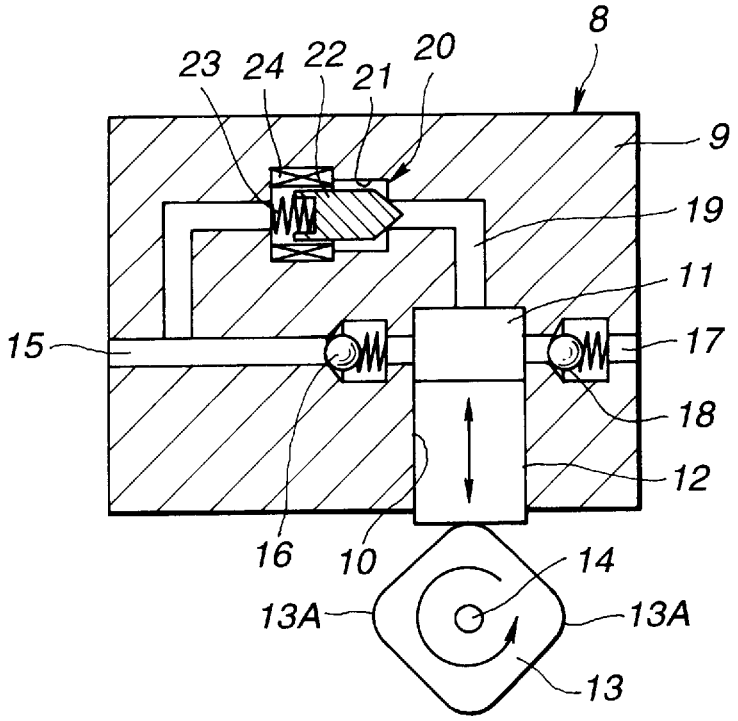
FIG. 2 is a longitudinal cross-sectional view illustrating a cam-driven high-pressure pump with a pump plunger moved at its top dead center.
Figure 3:
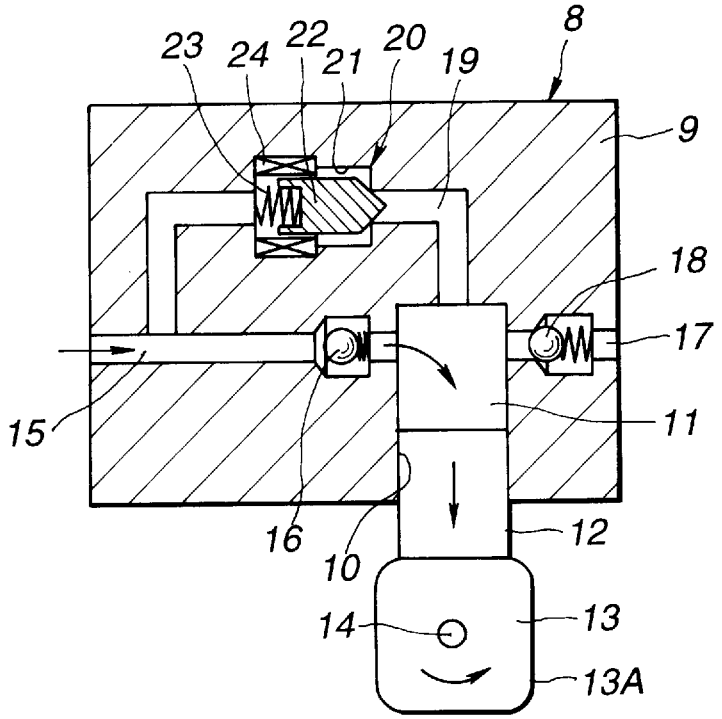
FIG. 3 is a longitudinal cross-sectional view illustrating a state of the cam-driven high-pressure pump during the suction stroke.
Figure 4:
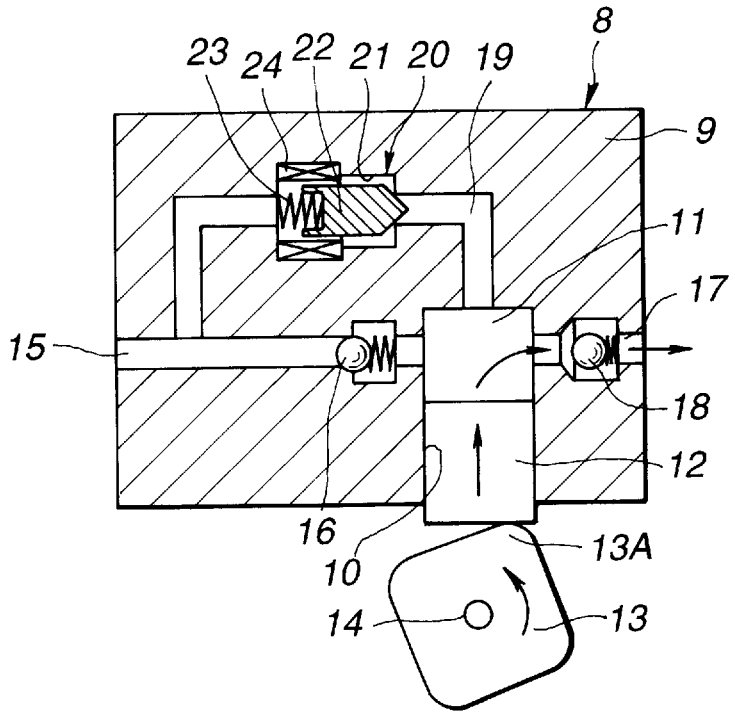
FIG. 4 is a longitudinal cross-sectional view illustrating a state of the cam-driven high-pressure pump during the discharge stroke.
Figures 8A, 8B:
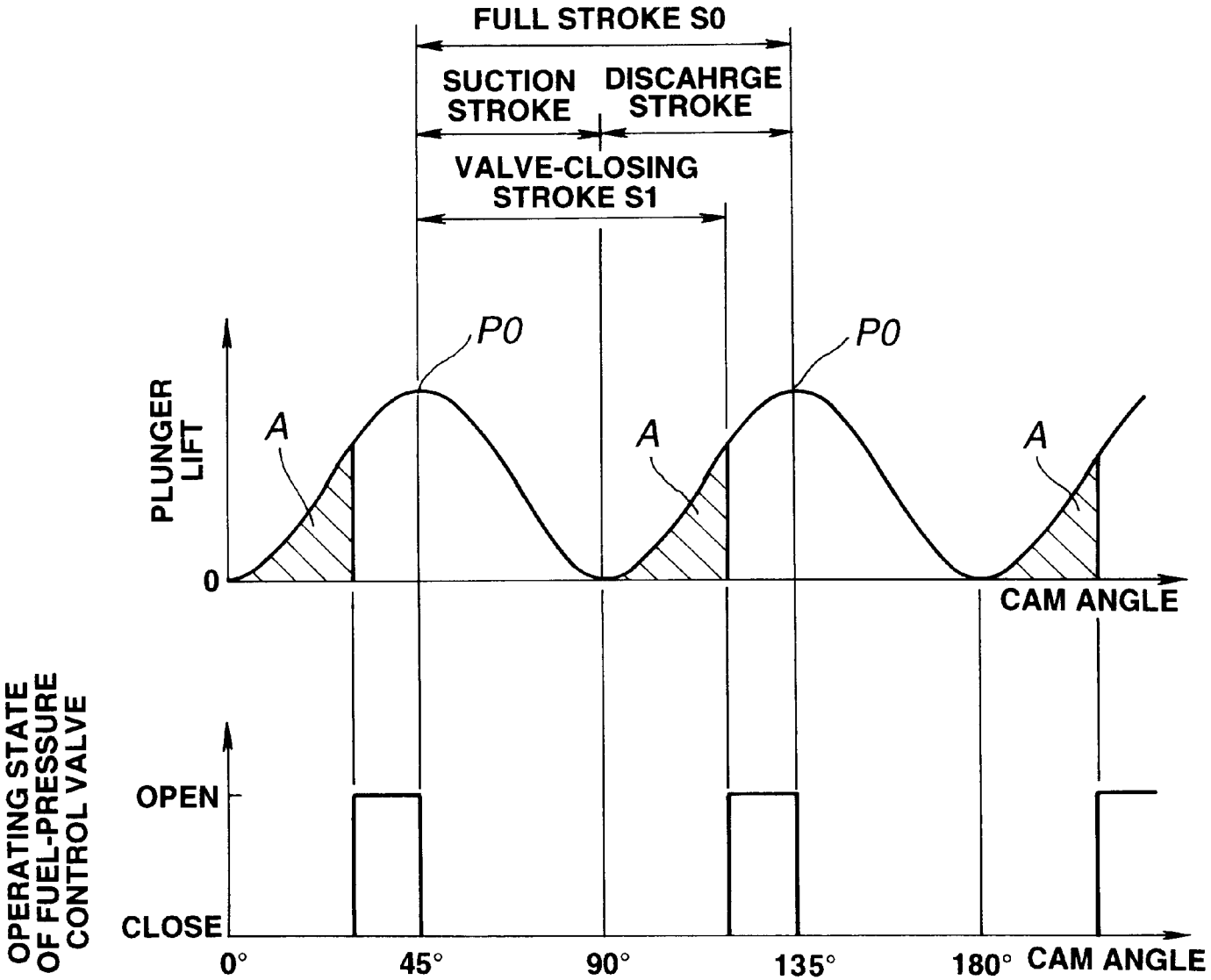
FIG. 8A is a graph showing the relationship between a cam angle and a plunger lift of the high-pressure pump.
FIG. 8B is a graph showing the relationship between the cam angle and an operating state of the fuel-pressure control valve.

As seen in FIGS. 2 and 3, the cam 13 is formed on its outer periphery with four lobes (13A, 13A, 13A, 13A)

corresponding to the number of the engine cylinders. The four cam lobes 13A are equally spaced in the circumferential direction of the cam. That is, the two adjacent cam lobes (13A, 13A) are angularly offset from each other by 360°/4 (i.e., 90 degrees). The cam 13 is integrally connected to the camshaft 14 mechanically linked to engine crankshaft (not shown). During the operation of the engine, the camshaft 14 revolves once for each two revolutions of the engine crankshaft so that the piston makes four strokes for each two crankshaft revolutions. In this manner, when the cam 13 rotates together with the camshaft 14, the plunger 12, being in cam-connection with the cam profile of the cam 13, follows the rotary motion of the cam 13. That is, the cam 13 functions to change its rotary motion to a reciprocating motion of the plunger 12. The details of the operation of the high-pressure pump 8 are described hereunder by reference to FIGS. 8A and 8B. As shown in FIGS. 8A and 8B, suppose that the angle of rotation that the camshaft 14 rotates by 90 degrees from an angular position corresponding to a top dead center P0 of the plunger 12 and then reaches again the angular position corresponding to the top dead center P0, is defined as a full stroke S0 of the high-pressure pump 8. One reciprocating motion of the plunger 12 is produced during the full stroke S0. As shown in FIG. 8A, the former half of the full stroke, that is, a period or an angular phase between 45 degrees and 90 degrees corresponds to a suction stroke during which the pressurized chamber 11 of the high-pressure pump 8 is enlarged (see FIG. 3). To the contrary, the latter half of the full stroke S0, that is, a period or an angular phase between 90 degrees and 135 degrees corresponds to a discharge stroke during which the pressurized chamber 11 is contracted (see FIG. 4). As shown in FIGS. 1 through 3, reference sign 15 denotes the suction fuel passage defined in the pump casing 9. As appreciated from FIGS. 1 and 2, the one end of the suction passage 15 is connected to low-pressure line 3, whereas the other end of the suction passage 15 is designed to communicate with the pressurized chamber 11 through the suction valve 16. The suction valve 16 is disposed in the suction passage 15 to allow the fluid flow from the low-pressure line 3 toward the pressurized chamber 11, and to check back-flow toward the lowpressure line 3. Reference sign 17 denotes the discharge fuel passage defined in the casing 9. One end of the discharge passage 17 communicates with the pressurized chamber 11 through the discharge valve 18, while the other end of the discharge passage 17 is connected via the high-pressure line 31 to the fuel rail 30, often called "common rail". The discharge valve 18 is disposed in the discharge passage 17 to allow fluid flow from the pressurized chamber 11 toward the high-pressure line 31, and to check or prevent back-flow toward the pressurized chamber 11. With the basic construction of the high-pressure pump 8, during the suction stroke shown in FIG. 3, the suction check valve 16 opens while closing the discharge valve 18, with the result that the fuel in the low-pressure line 3 is sucked through the suction passage 15 into the pressurized chamber 11. On the other hand, during the discharge stroke shown in FIG. 4, the suction valve 16 closes while opening the discharge valve 18, with the result that the fuel in the pressurized chamber 11 is discharged from discharge passage 17 into the high-pressure line 31 under high pressure such as 5 to 16 MPa. Reference sign 19 denotes the relief passage defined in the casing 9. The relief passage 19 is provided, so that one end of the relief passage 19 is connected to the downstream end of the suction passage 15 upstream of the suction side check valve 16, and that the other end of the relief passage 19 is connected to the pressurized chamber 11. With the fuel-pressure control valve 20, which will be fully described hereunder, fully opened, the relief passage 19 serves to relieve the fuel in the pressurized chamber 11 into the suction passage 15 (i.e., toward the low-pressure line) upstream of the suction side check valve 16. Reference sign 20 denotes an electromagnetically-controlled, spring-loaded fuel-pressure control valve disposed in the middle of the relief passage 19. In the shown embodiment, note that the fuel-pressure control valve 20 comprises a normally-closed type, electromagnetic solenoid pressure-relief valve. As seen in FIGS. 1 and 2, the fuel-pressure control valve 20 comprises the casing 9 also serving as a valve casing as well as a pump casing, a valve body 22 operably accommodated in the valve chamber 21 defined in the casing 9 and made of magnetic material such as iron, a valve return spring 23 disposed between the valve body 22 and the casing 9 for permanently biasing the valve body to its closed position, and an electromagnetic solenoid 24 fitted to the inner periphery of the valve chamber 21 for causing axial movement of the valve body 22. Although it is not clearly shown in the drawings, the solenoid 24 is electrically connected to a control unit 34, which will be fully described hereinbelow, through a signal line 25. When the solenoid 24 is de-energized in response to a command signal from the control unit 34, and the fuel pressure in the pressurized chamber 11 is below the maximum pressure level described later, the vale body 22 is held in its closed state by means of the spring bias of the spring 23. Conversely, when the solenoid 24 is excited or energized in response to a command signal from the control unit 34, the valve body 22 is electromagnetically attracted by means of the solenoid 24, thus opening the fuel-pressure control valve 20. Wit the previously-noted arrangement, the fuel-pressure control valve 20 can open only for a specified period of time, that is, during a specified angular phase of the cam 13 from the middle stage of the discharge stroke to the end of the discharge stroke of the high-pressure pump 8, by exciting the control valve 20 by the drive signal from the output interface of the control unit 34. During the previously-described specified time period (during the previously-described specified angular phase), the fuel in the pressurized chamber 11 is relieved through the relief passage 19 toward the low-pressure line 3. In this manner, the fuel pressure in the common rail 30 (that is, the pressure of fuel injected from the injector valve 32) can be variably controlled or regulated. Furthermore, the fuel-pressure control valve 20 is designed to open by way of shifting of the valve body 22 to the valve open position against the bias of the spring 23, when the fuel pressure in the pressurized chamber 11 exceeds the previously-noted maximum pressure level. For example, when the fuel pressure in the pressurized chamber 11 exceeds the predetermined maximum pressure level in presence of the signal-line failure of the solenoid 24, the valve body 22 can be shifted to its open position due to an excessively high pressure of the fuel in the pressurized chamber 11, thus permitting fuel relief from the pressurized chamber 11 via the relief passage 19 toward the low-pressure line 3. This maintains the pressure level of the fuel in the common rail 30 at the predetermined maximum pressure level. Reference sign 26 denotes a by-pass passage interconnecting the suction passage 15 and the discharge passage 17, while bypassing the pressurized chamber 11 of the high-pressure plunger pump 8. A one-way check valve 27 is disposed in the bypass passage 26. The bypass passage 26 is provided for rapidly rising the fuel pressure in the common rail 30 by ensuring the fuel supply from the low-pressure line 3 via the bypass passage 26 to the discharge passage 17 in addition to the fuel delivery from the suction passage via the pressurized chamber 11 to the discharge passage 17, when the fuel pressure in the common rail 30 is low for instance during a start-up period of the engine. Reference sign denotes an additional relief passage parallel-connected with the bypass passage 26. A relief valve 29 is disposed in the relief passage 28 to relieve the fuel prevailing in the common rail 30 toward the low-pressure line 3, when the fuel pressure in the common rail 30 greatly exceeds the predetermined maximum pressure level. Reference sign 30 denotes the common rail whose one end is connected to the discharge passage 17 of the high-pressure pump 8 via the high-pressure line 31. Generally, the common rail 30 is made of a metal tube and also the other end of the common rail is formed as a closed end. As may be appreciated from FIG. 1, the common rail 30 is formed integral with four fuel injector valves (32, 32, 32, 32) as a gallery type injector valve unit. A fuel-pressure sensor 33 is attached to the common rail 30 for detecting the fuel pressure of the fuel prevailing in the common rail 30. Reference sign 34 denotes the control unit provided in the automotive vehicle for the purpose of an electronic engine control. The control unit 34 is referred to as an "electronic engine control unit" or an "electronic engine control module", and abbreviated to "ECU" or "ECM". The control unit 34 is comprised of a microcomputer. The control unit 34, comprised of the microcomputer, typically includes an input/output interface, a control section employing a central processing unit (CPU) corresponding to the brain of the microcomputer, and a memory section 34A constructed by memories such as ROM (read only memory) and RAM (random access memory). The memory section 34A is designed to store a fuel injection control routine or processing as described later, a program for a fuel-pressure control processing, and a fuel-pressure setting data used for variably setting a target fuel pressure (or a desired fuel pressure) of the fuel in the common rail 30. In the shown embodiment, the target fuel pressure is selectable from three pressure levels, namely a normal pressure level (or a comparatively low pressure level) such as 4 to 6 MPa, a medium pressure level such as 6 to 8 MPa, and a high pressure level (or a maximum pressure level) such as 10 to 15 MPa, depending upon the engine speed and load. The memory section 34A pre-stores a valve-drive data through which the actual fuel pressure in the common rail 30 can be adjusted to the previously-described target fuel pressure by properly opening and closing the fuel-pressure control valve 20. The valve-drive data is pre-stored in the memory section 34A in the form of a preprogrammed characteristic map or a predetermined look-up table showing the relationship between the target fuel pressure of fuel in the common rail 30 and a valve-closing stroke S1 (or a valve-close stroke which will be fully described later). The input interface of the control unit 34 receives various input informational data from sensors, namely a cam position sensor 35, and a crank angle sensor 36, the fuel pressure sensor 33. The cam position sensor 35 is provided for detecting the angular position of the camshaft 14. The crank angle sensor 36 is provided for detecting the relative angular position of the crankshaft as well as an engine speed. On the other hand, the output interface of the control unit 34 is connected to the fuel-pressure control valve 20 via the signal line 25. Although it is not clearly shown in FIG. 1, the output interface of the control unit 34 is connected to the low-pressure pump and also to the respective fuel injector valves (32, 32, 32, 32). That is, the low-pressure pump 2 is turned on and off by a command signal from the output interface of the control unit. Additionally, the fuel injectors (32, 32, 32, 32) are pulsed open and closed by a command signal from the output interface of the control unit. Although it is not clearly shown in FIG. 1, the input interface of the control unit 34 is generally connected to a throttle position sensor or to an accelerator-opening sensor for detecting engine load. The control unit 34 sets a target fuel pressure of the fuel in the common rail 30 at either one of the previously-noted three pressure levels, depending on the engine operating condition. The control unit 34 operates to open the fuel-pressure control valve 20, only during a specified period of time from the middle stage of the discharge stroke to the end of the discharge stroke, by exciting the valve 20 at a specific timing based on the target fuel pressure, thus variably controlling or regulating the fuel pressure of fuel in the common rail 30.

Figure 6:
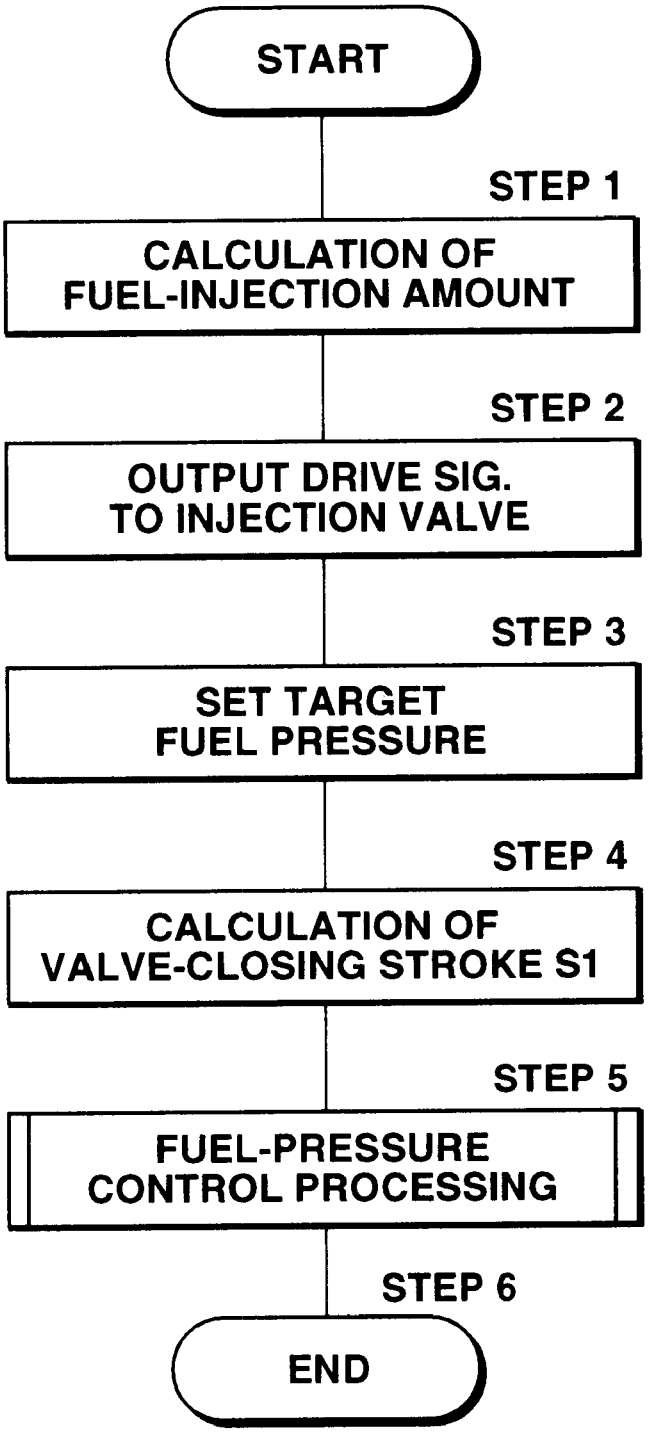
FIG. 6 is a flow chart showing a fuel injection control processing executed by a control unit employed in the fuel injection system of the invention.

The fuel injection control processing executed by the control unit 34, employed in the fuel injection control system of the embodiment, is hereunder discussed in detail by reference to the flow chart of FIG. 6. During the operation of the engine, the full stroke S0 (see FIGS. 8A and 8B) of the high-pressure pump 8 is repeated four times during one camshaft revolution. The fuel injection control processing (or the fuel injection control routine) defined by steps 1 through 6 shown in FIG. 6 is executed for each full stroke S0. This routine is usually executed as time-triggered interrupt routines to be triggered every predetermined sampling intervals.

Figure 7:
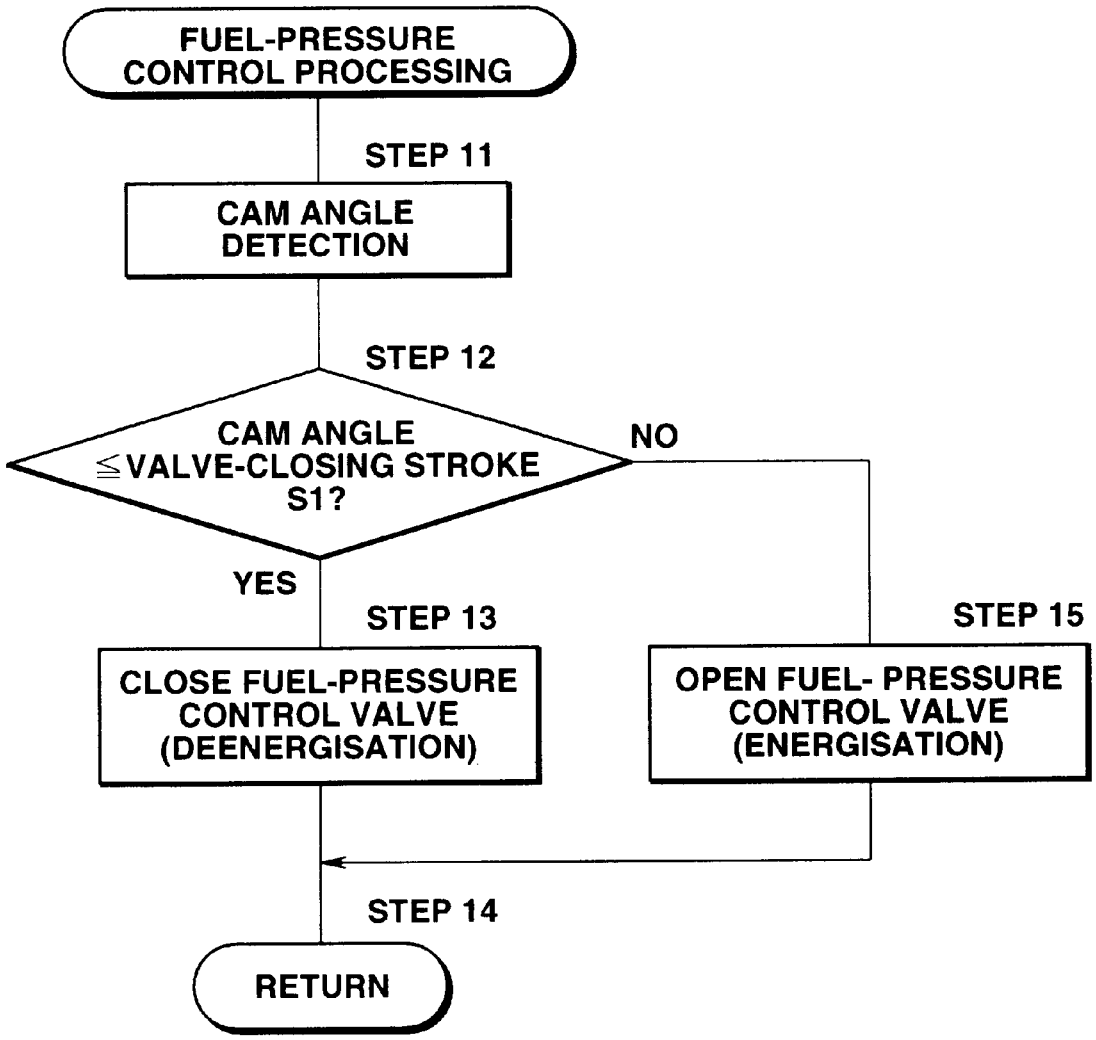
FIG. 7 is a flow chart showing a fuel-pressure control processing performed by the control unit.

In step 1, a fuel injection amount to be injected into each engine cylinder is calculated depending on the engine operating condition, such as engine speed and engine load. In step 2, a drive signal or a command signal, corresponding to the injection amount, calculated through step 1, is output to the injector valve 32. The drive signal corresponds to a duty-cycle signal or a pulse-width time signal (or a pulse-width modulated voltage signal often called a "PWM signal") which is generated from the control unit 34. Thus, the opening and closing of each of the injector valves 32 is controlled or regulated in response to the drive signal consisting of a duty-cycle signal. In more detail, with an increased duty cycle or the increased solenoid ON time or the increased solenoid valve opening time of the injector valve 32, the amount of injection of fuel from the common rail 30 through the injector valve to the associated engine cylinder is increased. In step 3, depending on the engine speed and the engine load, a target fuel pressure of the fuel in the common rail 30 is variably set in reference to or retrieved from the predetermined fuel-pressure setting data stored in the memory section 34A. For example, during engine idling where a small quantity of fuel injection amount is injected, the target fuel pressure of the fuel in the common rail 30 is set at the previously-noted normal pressure level (i.e., a comparatively low pressure level). To the contrary, during high engine load where a large quantity of fuel injection amount is required, the target fuel pressure is set at the predetermined maximum pressure level. In step 4, in order to feedback-control the fuel pressure in the fuel in the common rail 30 so that the actual fuel pressure in the common rail is adjusted to the target fuel pressure calculated at step 3, the valve-close stroke S1 of the fuel-pressure control valve 20 is arithmetically calculated in reference to or retrieved from the map data which is pre-stored in the memory section 34A and illustrates the relationship between the target fuel pressure and the valve-close stroke S1. Concretely, the CPU of the control unit 34 uses the fuel-pressure indicative signal sent from the fuel-pressure sensor 33 and the latest up-to-date informational data indicating the amount of injection of fuel injected through the injector valve 32, to properly compensate for the calculated valve-close stroke S1 of the fuel-pressure control valve 20. Of the full stroke S0 (one cycle from a certain peak P0 to the next peak P0, that is, a time interval defined by the cam angle of 45 degrees to 135 degrees), the valve-close stroke S1 is defined as a time duration (or an angular phase of the cam 13) where the fuel-pressure control valve 20 is maintained in its closed state. For example, in FIG. 8, the valve-close stroke S1 is identical to a time duration from the start of the suction stroke (corresponding to a point of time of the cam angle of 45°) to the middle stage (substantially corresponding to the cam angle of 120°) of the discharge stroke. In step 5, the fuel-pressure control processing is executed. Thereafter, in step 6, one cycle of the fuel injection control processing terminates. FIG. 7 shows one example of the fuel-pressure control processing of step 5 shown in FIG. 6. The sub-routine of FIG. 7 is executed as time-triggered interrupt routines to be triggered every predetermined time intervals such as 10 milliseconds. Therefore, the sub-routine shown in FIG. 7 is repeatedly executed during the whole stroke S0 of the high-pressure pump 8.

Figure 5:
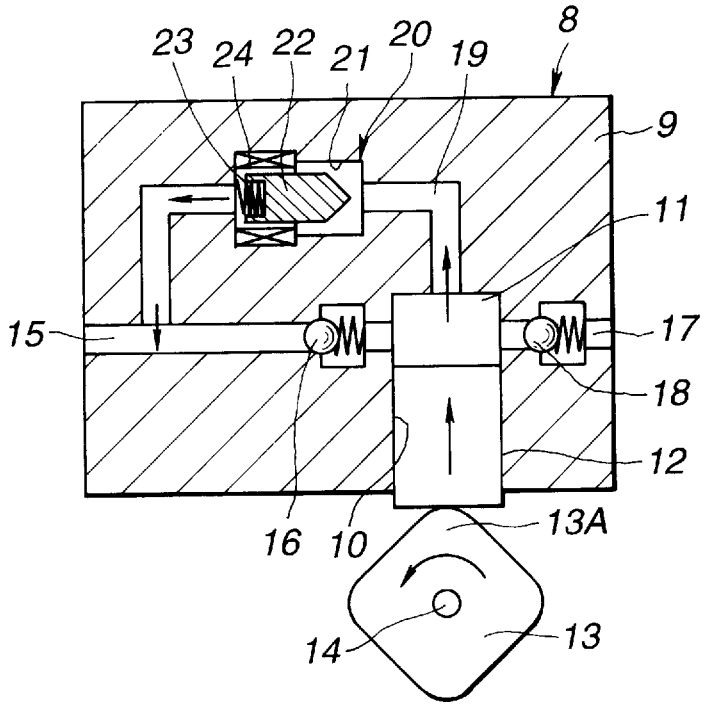
FIG. 5 is a longitudinal cross-sectional view illustrating the open state of the fuel-pressure control valve during the middle stage of the discharge stroke.

In step 11, the control unit 34 uses the signal from the cam position sensor 35 and the signal from the crank-angle sensor 36, to detect the current cam angle of the camshaft 14 with respect to the top dead center P0 of the pump plunger 12. Thereafter, in step 12, a test is made to determine whether the detected value of the cam angle of the camshaft 14 is within the valve-close stroke S1. When the answer to step S12 is in the affirmative (YES), that is, when the control unit 34 determines on the basis of the detected cam angle that the fuel-pressure control valve 20 is closed in the valve-close stroke, the high-pressure pump 8 is operating in the middle stage of the suction stroke or operating in the middle stage of the discharge stroke, so as to discharge the fuel necessary to maintain the target fuel pressure of the fuel in the common rail 30. For the reasons discussed above, in step 13, the fuel-pressure control valve 20 is de-energized, and thus the control valve 20 is shifted to the closed state. Then, in step 14, the sub-routine returns to the main routine shown in FIG. 6. In this manner, when the cam angle is within the valve-close stroke S1, the fuel-pressure control valve 20 is kept in the valve-closed state shown in FIGS. 3 and 4, in accordance with the flow from step 12 via step 13 to step 14. On the suction stroke, the high-pressure pump 8 sucks the fuel in the low-pressure line 3 through the suction passage 15 into the pressurized chamber 11. Thereafter, during the time duration from the start of the discharge stroke to the middle stage of the discharge stroke, the pressurized fuel is discharged through the discharge passage 17 into the high-pressure line 31. Conversely, when the answer to step S12 is in the negative (NO), that is, when the control unit 34 determines that the detected cam angle is out of the valve-close stroke S1, the control unit decides that the discharge mode of the injection system has been completed and thus an adequate amount of fuel has already been discharged into the common rail 30. In such a case, step 15 occurs. In step 15, the drive circuit of the control unit 34 begins to energize the fuel-pressure or maintains the energizing state of the fuel-pressure control valve 20. Thereafter, step 14 enters in which the procedure returns to the main routine. As explained in reference to FIGS. 6 and 7, the fuel-pressure control valve 20 is opened only during the specified period of time from the middle stage of the discharge stroke to the end of the discharge stroke, as seen in the timing charts shown in FIGS. 8A and 8B. As seen in FIG. 5, during the valve-open period of the fuel-pressure control valve 20, the fuel in the pressurized chamber 11 is relieved through the relief passage 19 toward the suction passage 15 (toward the low-pressure line), but not discharged into the high-pressure line 31. Owing to such fuel relief, the discharge stroke of the high-pressure pump 8 with respect to the current full stroke S0 practically ends. Out of the whole discharge stroke (corresponding to the latter-half zone of the full stroke S0, that is, the angular phase defined between 90 degrees and 135 degrees), the actual fuel-discharge action of the high-pressure pump 8 is achieved only for the time duration indicated by the hatched zone A corresponding substantially to the latter half of the valve-close stroke S1. For instance, during the high engine load, if the valve-close stroke S1 is set at a greater value to regulate the fuel pressure of the fuel in the common rail 30 to the predetermined maximum pressure level, the amount of fuel discharged from the high-pressure pump 8 increases according to an increase in the area of the hatched zone A, thereby rising the fuel pressure of the fuel in the common rail. To the contrary, if the valve-close stroke S1 is set at a comparatively small value to regulate the fuel pressure of the fuel in the common rail 30 to the normal pressure level during idling, the discharge amount of fuel discharged from the high-pressure pump 8 decreases, thus dropping the fuel pressure of the fuel in the common rail 30. As discussed above, the control unit 34 is able to variably control or regulate the fuel pressure of the fuel in the common rail 30 by varying the length of the valve-close stroke S1. On the other hand, in the case that the fuel pressure of the fuel in the common rail 30 must be rapidly risen up from the normal pressure level to the maximum pressure level, the control unit 34 operates to maintain the fuel-pressure control valve 20 at the closed state all over the full stroke S0 containing both the suction stroke and the discharge stroke, so that the full stroke S0 becomes identical to the valve-close stroke S1. In other words, in the presence of the necessity of rapid rise of the fuel pressure of the fuel in the common rail 30, all of the discharge stroke is assigned to the hatched zone A corresponding to the actual fuel-discharge action angular phase. With the hatched zone widely increased, the high-pressure pump 8 can perform the fuel discharging action with the maximum discharge amount. Conversely, in the case that the fuel pressure of the fuel in the common rail 30 must be rapidly dropped down from the maximum pressure level to the normal pressure level, the control unit 34 operates to maintain the fuel-pressure control valve 20 at the open state all over the full stroke So containing both the suction stroke and the discharge stroke, so as to set the full stroke S0 at a so-called valve-open stroke. In this case, there is no valve-close stroke S1. In other words, in the presence of the necessity of rapid drop of the fuel pressure of the fuel in the common rail 30, there is no hatched zone A. Thus, the actual discharging action is not executed. As set out above, as appreciated from the pulse-like waveform shown in FIG. 8B, the control unit 34 can vary the end of the actual discharging action of the pump 8 by variably controlling the open timing (the energisation timing or activation timing) of the normally-closed type fuel-pressure control valve 20, which open timing corresponds to the leading edge of the pulsed waveform of FIG. 8B. On the other hand, the close timing of the normally-closed type fuel-pressure control valve 20 is fixed to the end of the discharge stroke of the high-pressure pump 8 (see a point of time of the cam angle of 45° or 135° in FIG. 8B).

As set forth above, in the embodiment shown in FIGS. 1 through 8B, the normally-closed type fuel-pressure control valve 20, including at least the valve body 22, the valve return spring 23, and the electromagnetic solenoid 24, is provided in the relief passage 19 of the high-pressure pump 8, and additionally the fuel pressure of the fuel in the common rail 30 can be controlled or regulated by opening the fuel-pressure control valve 20 only for a time duration from middle stage of the discharge stroke of the pump 8 to the end of the discharge stroke. Thus, during the latter-half period of the discharge stroke of the pump 8, the fuel in the pressurized chamber 11 of the pump 8 can be relieved via the relief passage 19 into the low-pressure line 3. Accordingly, the termination timing (the end of the valve-close stroke S1) of the fuel discharging action can be adjusted by way of a proper control of the valve-open timing for the normally-closed type fuel-pressure control valve 20. This allows a proper adjustment of the amount of fuel discharged from the high-pressure pump 8 into the common rail 30. Simultaneously, the system of the embodiment, the fuel pressure of the fuel in the common rail 30 (that is, the fuel pressure of the fuel injected from the injector valve 32) can be controlled or regulated depending upon the engine operating condition, such as engine speeds and load, by virtue of the fuel injection control processing executed by the control unit 34 and the use of the normally-closed type fuel-pressure control valve 20. The use of the normally-closed type fuel-pressure control valve 20 is very advantageous, because the fuel-pressure control valve 20 can be kept in the closed state even when the signal line 25 for the fuel-pressure control valve 20 fails or the solenoid failure of the control valve 20 takes place, and thus ensuring the discharging action of the fuel from the low-pressure line 3 via the high-pressure pump 8 into the common rail 30. As may be appreciated, the satisfactory fuel relief can be obtained by suitably setting the pre-load of the valve return spring 23, applied to the valve body 22. By properly setting the pre-load (equivalent to the set relief pressure for the fuel-pressure control valve 20), when the fuel pressure of the fuel in the common rail 30 exceeds the predetermined maximum pressure level, the valve body 22 of the control valve 20 can be shifted to its open position against the bias of the return spring 23, so that surplus fuel in the pressurized chamber 11 can be relieved through the relief passage 19 toward the low-pressure line 3. Therefore, according to the system of the embodiment, even when the solenoid 24 of the fuel-pressure control valve 20 fails, the fuel in the low-pressure line 3 is able to be stably delivered through the high-pressure pump 8 into the common rail 30. Also, the proper setting of the pre-load of the return spring 23 allows regulation of the fuel pressure of the fuel in the common rail 30 to the predetermined maximum pressure level. As discussed above, the reliability of the fuel injection system can be enhanced. Furthermore, the system of the embodiment can variably control the ratio of the valve-close stroke S1 to the whole stroke So containing both the suction stroke and the discharge stroke, thus permitting the actual fuel-discharge action angular phase (an area of the hatched zone A) of the camshaft 14 to vary together with the change in the length of valve-close stroke S1. The discharge amount of fuel from the pump 8 can be increased or decreased depending on the length of the valve-close stroke S1, so that the fuel pressure of the fuel in the common rail 30 is regulated certainly in response to the calculated target fuel pressure by means of the control unit 34 and the fuel-pressure control valve 20. Additionally, as seen in FIGS. 8A and 8B, the valve-close stroke S1 is determined by means of the control unit and the fuel-pressure control valve, and thus the fuel-pressure control valve 20 can be continually conditioned in the open state when the plunger 12 of the pump 8 follows the rotary motion of the cam lobe 13A of the cam 13 and then reaches a position near the top dead center P0. Therefore, during the latter-half stage of the discharge stroke, where the fuel pressure within the pressurized chamber 11 is risen to a considerably high level, the fuel in the pressurized chamber 11 can be relieved through the relief passage 19 toward the low-pressure line 3. Thus, the load imparted to the camshaft 14 for pump drive can be effectively reduced, thus ensuring energy conservation with respect to the engine. This also suppresses a cam-lobe wear of the cam 13, and consequently enhances the durability of the high-pressure pump 8. Moreover, since the target fuel pressure of the fuel in the common rail 30 can be selected as the best one from among three pressure levels, namely a normal pressure level such as 4–6 MPa, a medium pressure level such as 6–8 MPa, and a maximum pressure level such as 10–15 MPa, the actual fuel pressure within the common rail 30 can be switchable in the manner of three steps, depending on the engine operating condition. This permits the fuel prevailing in the common rail 30 to stably inject through the injector valve 32.

Additionally, the control unit operates to maintain the fuel-pressure control valve 20 at the valve closed state throughout the whole stroke S0 containing both the suction stroke and the discharge stroke when a rapid rise in the fuel pressure within the common rail 30 is required. On the other hand, the control unit operates to maintain the control valve 20 at the valve open state throughout the whole stroke S0 when the a rapid drop in the fuel pressure within the common rail 30 is required. As a result of this, the fuel pressure within the common rail 30, that is, the fuel pressure of the fuel injected from the injector valve 32, can be rapidly risen or dropped, thus ensuring a rapid and proper fuel-pressure control. In the previously-noted embodiment, the relief passage 19 and the fuel-pressure control valve 20 are provided in the high-pressure pump unit, so that the hydraulic line 19 and the valve unit 20 are arranged between the suction passage 15 and the pressurized chamber 11 through the suction-side check valve 16, and also the plunger 12 is designed to reciprocate in the cylinder 10 by way of the cam 13 linked to or attached to the camshaft 14. Thus, the high-pressure pump having a fuel-pressure control function, can be small-sized. Owing to the simplified drive mechanism, the fuel-injection control system itself can be small-sized.

Furthermore, the low-pressure pump 2 is connected to the suction passage 15, included in the high-pressure pump unit, via the low-pressure line 3, and also the common rail 30 is connected to the discharge passage 17 through the high-pressure line 31. Thus, the fuel discharged from the low-pressure pump 2, can be further pressurized by means of the high-pressure pump 8, and then the pressurized fuel can be discharged into the common rail 30. Such a two-step pressurizing system ensures a stable fuel delivery of a high pressure level. Moreover, the common rail 30 is formed integral with a plurality of fuel injector valves (four injector valves in the shown embodiment) as a gallery type injector valve unit, and thus the fuel fed into a sole common rail 30 can be certainly injected into the engine cylinders through the respective injector valves 32. This simplifies the fuel-delivery system, and also ensures easy installation of the fuel-delivery system when assembling the engine.

Figure 9:
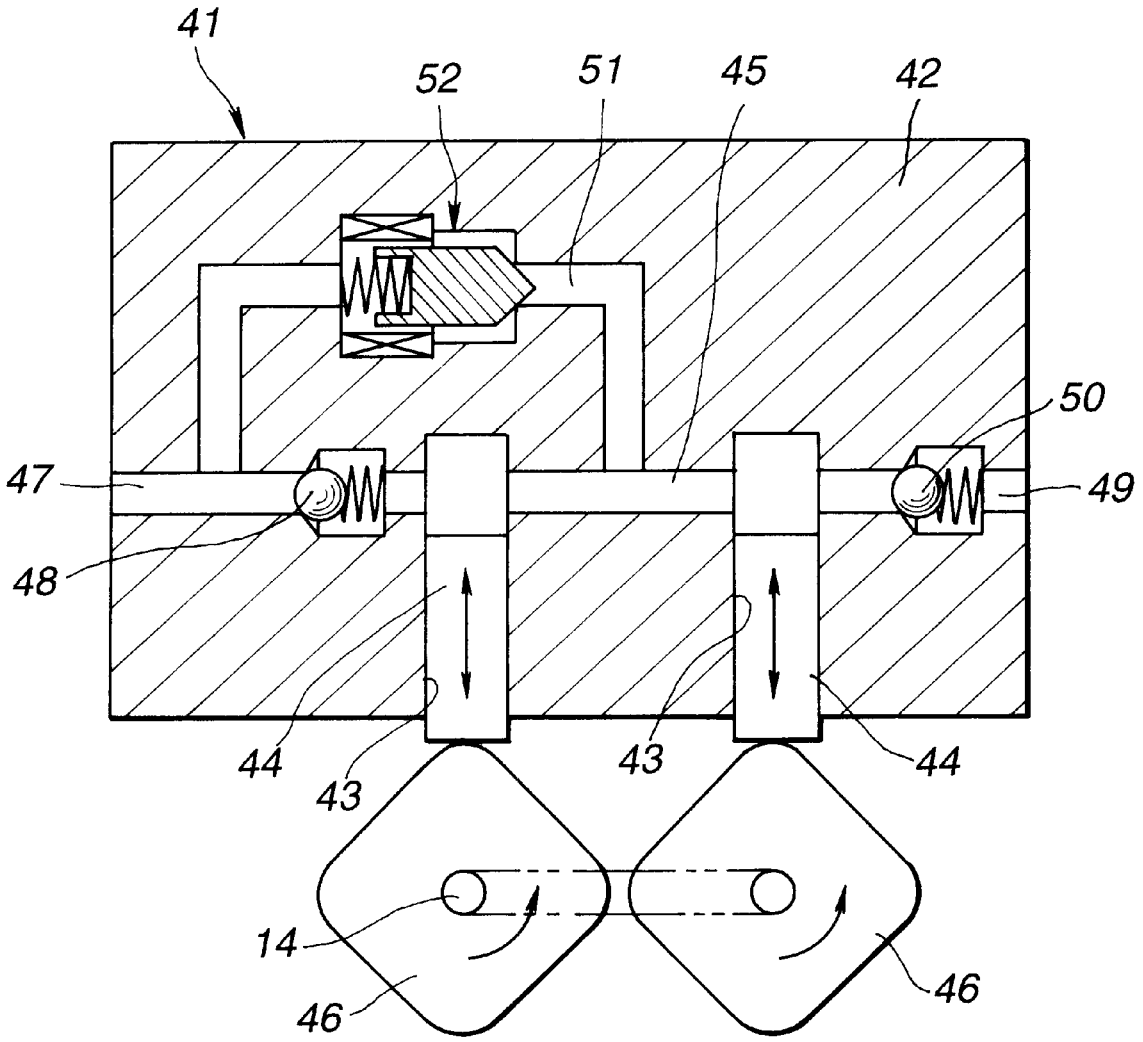
FIG. 9 is a longitudinal cross-sectional view illustrating a modification of a high-pressure pump employed in a fuel injection control system of the invention.

Referring now to FIG. 9, there is shown the modification of a high-pressure pump applicable to the fuel injection system of the present invention. The modified high-pressure pump unit 41 shown in FIG. 9 is somewhat different from the high-pressure pump unit 8 shown in FIGS. 1–5, in that the modified high-pressure pump unit 41 is constructed as a dual-plunger pump unit. As shown in FIG. 9, the modified pump unit 41 comprises a pump casing 42, two cylinders (43, 43) defined in the casing 42, and two plungers (44, 44) each of which is reciprocatingly accommodated in the associated cylinder 43 and defines a pressurized chamber in the casing in cooperation with the inner wall surface of the cylinder 43. The modified pump unit 41 also comprises two cams 46 being in cam-connection with the respective plungers (44, 44). As clearly seen in FIG. 9, the left-hand cam 46 has a driven connection with the camshaft 14, while the right-hand cam 46 has a driven connection with a drive shaft (not numbered) fixedly connected to the center of the right-hand cam 46. The right-hand drive shaft is belt-driven so that the right-hand drive shaft can rotate at the same speed as the camshaft 14 in synchronization with rotary motion of the camshaft 14. In the modified high-pressure pump unit 41, the volumetric capacity of each of the cylinders (43, 43) is designed to be substantially ½ the volumetric capacity of the cylinder 10 of the high-pressure pump 8 shown in FIGS. 1 and 2. The pressurized chamber 11 associated with the left-hand cylinder 43 communicates with the pressurized chamber 11 associated with the right-hand cylinder 43 by way of a communication passage 45 which has a predetermined length and constructs part of the pressurized chambers 11. In the same manner as the high-pressure pump unit 8 shown in FIGS. 1 and 2, a suction-side check valve 48 is disposed in a suction passage 47 (connected to the low-pressure line 3) just upstream of the pressurized chamber associated with the left-hand cylinder 43, whereas a discharge-side check valve 50 is disposed in a discharge passage 49 (connected to the high-pressure line 31) just downstream of the pressurized chamber associated with the right-hand cylinder 43. In the modified high-pressure pump unit 41, one end of a relief passage 51 is connected to the communication passage 45, while the other end of the relief passage 51 is connected to the suction passage 47 just upstream of the suction-side check valve 48. In the same manner as the embodiment previously explained by reference to FIGS. 1–5, a fuel-pressure control valve 52 is fluidly disposed in the relief passage 51 for opening and closing the relief passage. The system employing the modified high-pressure pump unit 41 can provide the same effects as the system employing the high-pressure pump unit 8 of the embodiment shown in FIG. 1. In the case of the system using the modified high-pressure pump unit 41, undesired fuel-pressure pulsation which may occur in the respective cylinders (43, 43) can be effectively reduced by the provision of the communication passage 45 having a pre-selected axial length. This contributes to stabilization of the fuel pressure within the common rail 30.

Figure 10:
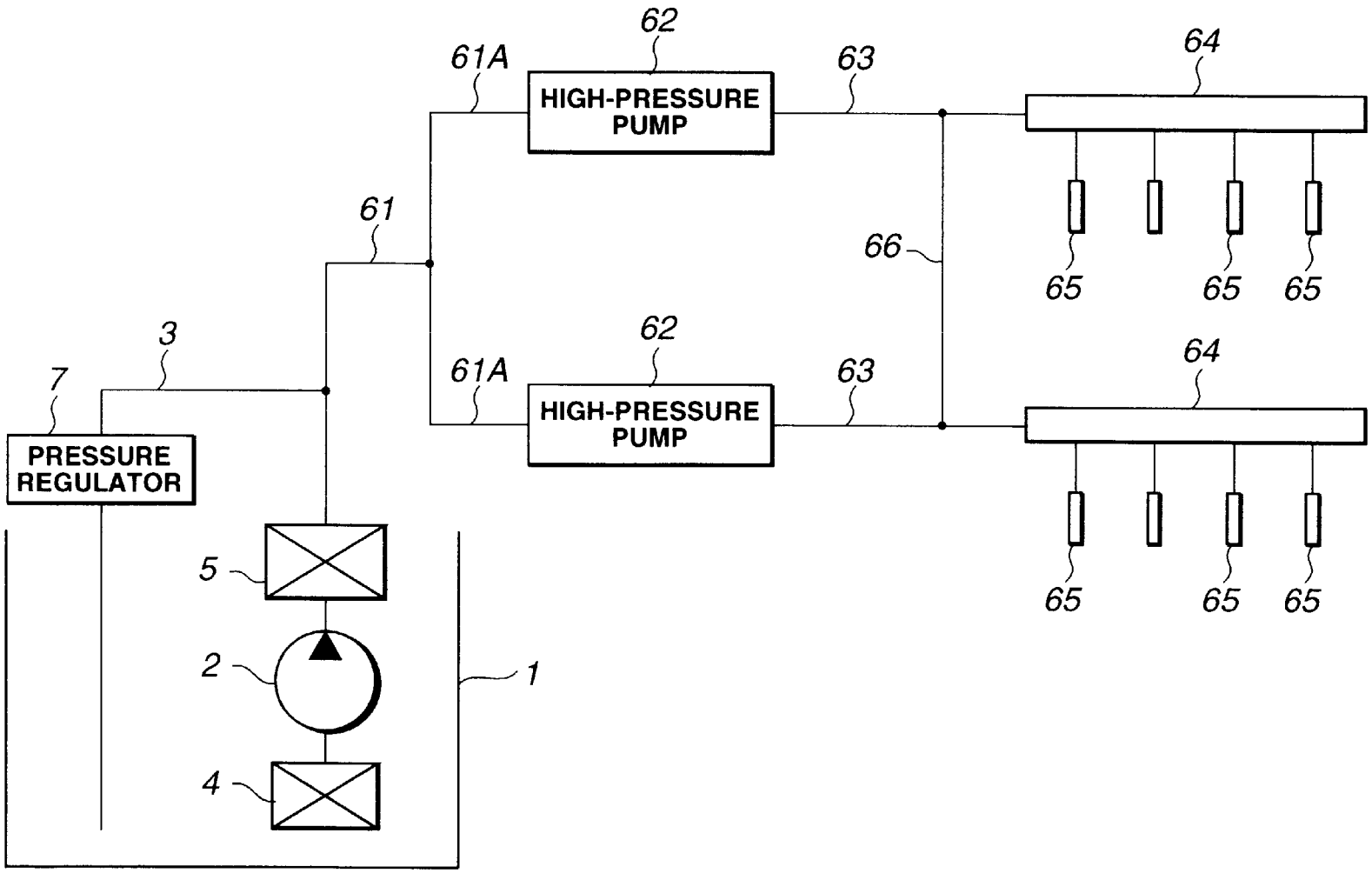
FIG. 10 is a system block diagram illustrating another embodiment of a fuel injection control system of the invention.

Referring to FIG. 10, there is shown another embodiment of the fuel injection control system. The fuel injection control system of the other embodiment shown in FIG. 10 is different from that of the first embodiment shown in FIGS. 1–5, in that the downstream end of the low-pressure line 61 is branched into two branch lines (61A, 61A), and inlet ports of two high-pressure pump units (62, 62) are connected to the respective branch lines (61A, 61A). The discharge port of a first pump of the two high-pressure pumps (62, 62) is connected via a first high-pressure line 63 to a first common rail 64, whereas the discharge port of a second pump of the two high-pressure pumps (62, 62) is connected via a second high-pressure line to a second common rail 64. Each of the high-pressure pump units (62, 62) has substantially the same construction as that of the high-pressure pump unit 8 of the first embodiment shown in FIG. 1. In the embodiment shown in FIG. 10, each of the common rails (64, 64) is formed integral with four fuel injector valves (65, 65, 65, 65). In FIG. 10, reference sign 66 denotes a pulsation-suppressive communication passage intercommunicating the two high-pressure lines (63, 63). The pulsation-suppressive communication passage 66 functions to suppress undesired pulsation in the fuel discharged from the respective high-pressure pumps (62, 62), such that the pulsation in fuel discharged from the first high-pressure pump counteracts the pulsation in fuel discharged from the second high-pressure pump by means of the communication passage 66 having a predetermined length effective to suppress undesired pulsation. As can be appreciated from the arrangement of the injection system shown in FIG. 10, the system of FIG. 10 is optimally applicable to a V type engine with two cylinder banks, such as a V-6 engine using two three-cylinder banks or a V-8 engine using two four-cylinder banks. The system of FIG. 10 is exemplified in a V-8 engine. As discussed above, the provision of the pulsation-suppressive communication passage 66 is effective to stabilize the fuel pressure within the respective common rail 64.

In the shown embodiments, a single plunger type high-pressure pump or a dual-plunger type high-pressure pump are exemplified as a rotary-cam driven high-pressure plunger pump. Alternatively, a multi-plunger pump, having three or more plungers, may be used in lieu thereof. In the dual-plunger type pump shown in FIG. 9, the two pumping sections are arranged parallel to each other, and each of the plunger is driven by the corresponding cam. In lieu thereof, it will be appreciated that a plurality of plungers are radially arranged with respect to the center axis of the camshaft 14, and inner end faces of these plungers are in cam-connection with a sole cam fixedly connected to the camshaft 14, for causing reciprocating motion of each plunger during rotary motion of the sole cam. Furthermore, in the shown embodiments, the fuel-pressure control valves (20, 52) are incorporated in the plunger-pump casing (9, 42). The solenoid valve casing accommodating the fuel-pressure control valve (20, 52) may be formed as a separate casing separated from the plunger-pump casing (9, 42) so that the solenoid valve (20, 52) is disposed in the relief passage (19, 51) defined in the separate casing. Moreover, in the embodiments, the relief passage (19, 51) is formed in the pump casing (9, 42) together with the fuel-pressure control valve (20, 52). In place thereof, the relief passage (19, 51) may be formed as a detachable relief conduit or a detachable relief pipe, connectable to the fluid passage/chamber(15, 11; 47, 45) defined in the pump casing (9, 42). In this case, the fluid-pressure control valve (20, 52), consisting of a normally-closed type electromagnetic solenoid valve, may be disposed in the relief conduit or the relief pipe, in the exterior of the pump casing (9, 42). In the embodiment shown in FIG. 1, the system of the invention is exemplified in a four-cylinder engine. In the embodiment shown in FIG. 10, the system of the invention is exemplified in a V-8 engine. It will be easily understood that the system of the invention may be applicable to various types of an internal combustion engine, regardless of the number of engine cylinders, the arrangement of engine cylinders, the arrangement of valves, the type of cooling system, the type of fuel, and the type of cycle (Otto or diesel). Moreover, in the shown embodiments, although the suction-side one-way check valve (16, 48) and the discharge-side one-way check valve (18, 50) are comprised of a ball check valve, these valves may be comprised of another type of check valve, for example, a poppet check valve or a reed valve, which is capable of automatically limiting fluid flow in a piping system in a single direction.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A fuel injection control system for an internal combustion engine, comprising:

a plurality of fuel injector valves injecting fuel into respective engine cylinders of an internal combustion engine;

a pumping system having a suction valve connected between a low-pressure line and a pressurized chamber for permitting fuel flow from the low-pressure line toward the pressurized charger on a suction stroke, a discharge valve connected between a high-pressure line and the pressurized chamber for permitting fuel flow from the pressurized chamber toward the high-pressure line on a discharge stroke, and a fuel pumping section provided for sucking fuel into the pressurized chamber with the suction valve opened on the suction stroke and for discharging the fuel in the pressurized chamber toward the injector valves with the discharge valve opened on the discharge stroke;

a relief passage connected, at one end, to the low-pressure line upstream of the suction valve, and connected, at another end, to the pressurized chamber; and a fuel-pressure control valve disposed in said relief passage for regulating a fuel pressure of the fuel injected from each of the fuel injector valves by opening said fuel-pressure control valve only for a specified time duration from a controllable middle stage of the discharge stroke to an end of the discharge stroke, wherein said fuel-pressure control valve comprises a normally-closed relief valve capable of closing during the suction stroke and for a time duration from a start of the discharge stroke to the controllable middle stage of the discharge stroke, and of opening only for the specified time duration from the controllable middle stage of the discharge stroke to the end of the discharge stroke.

2. The fuel injection control system as claimed in claim 1, which further comprises a control unit for variably controlling a ratio of a valve-close stroke (S1) of said fluid-pressure control valve, defined as a time duration from a start of the suction stroke to the middle stage of the discharge stroke, to a whole stroke (S0) corresponding to a time period from the start of the suction stroke to the end of the discharge stroke.

3. The fuel injection control system as claimed in claim 2, wherein said fluid-pressure control valve comprises a normally-closed, electromagnetic solenoid valve, said electromagnetic solenoid valve comprising:

a valve casing defining therein a fluid passage;

a valve body fluidly disposed in the fluid passage defined in said valve casing;

a return spring permanently biasing said valve body in a direction closing said valve body; and an electromagnetic solenoid energized by a command signal generated from said control unit only for the specified time duration from the controllable middle stage of the discharge stroke of said pumping system to the end of the discharge stroke, for maintaining said fuel-pressure control valve at a valve-open state only for the specified time duration.

4. The fuel injection control system as claimed in claim 3, wherein said pumping system comprises a reciprocating fuel pump, said reciprocating-fuel pump comprising:

at least one cylinder;

at least one plunger accommodated in said at least one cylinder so that said at least one plunger is reciprocatable in said at least one cylinder, and cooperating with said at least one cylinder to define the pressurized chamber; and a cam being in cam-connection with an end of said at least one plunger, for converting a rotary motion of said cam into a reciprocating motion of said at least one plunger.

5. The fuel injection control system as claimed in claim 4, wherein said pumping system comprises a high-pressure pump connected, at a suction side, to a low-pressure pump capable of sucking fuel stored in a fuel tank and discharging the fuel of a low-pressure level, and connected, at a discharge side, to the fuel injector valves.

6. The fuel injection control system as claimed in claim 5, which further comprises a common rail being formed integral with the fuel injector valves as a gallery type injector valve unit.

7. The fuel injection control system as claimed in claim 6, wherein said control unit outputs a command signal to said fuel-pressure control valve for closing said fuel-pressure control valve during the whole stroke (S0) including both the suction stroke and the discharge stroke in presence of a demand for a rapid rise in fuel pressure of the fuel injected from each of the fuel injector valves.

8. The fuel injection control system as claimed in claim 7, wherein said control unit outputs a command signal to said fuel-pressure control valve for opening said fuel-pressure control valve during the whole stroke (S0) including both the suction stroke and the discharge stroke in presence of a demand for a rapid drop in fuel pressure of the fuel injected from each of the fuel injector valves.

9. The fuel injection control system as claimed in claim 2, wherein said valve-close stroke (S1) is determined by a target fuel pressure based on an engine speed and an engine load.

10. The fuel injection control system as claimed in claim 9, wherein said control unit variably controls a length of the valve-close stroke (S1) by varying a timing of opening of said fuel-pressure control valve in the controllable middle stage of the discharge stroke of the pumping system, and said control unit fixes a timing of closing of said fuel-pressure control valve to the end of the discharge stroke.

* * * * *